US010287830B2

(12) United States Patent
Brown

(10) Patent No.: US 10,287,830 B2
(45) Date of Patent: May 14, 2019

(54) COMBINED CASING AND DRILL-PIPE FILL-UP, FLOW-BACK AND CIRCULATION TOOL

(71) Applicant: Frank's International, LLC, Houston, TX (US)

(72) Inventor: Dougal Brown, Forres (GB)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 236 days.

(21) Appl. No.: 15/350,375

(22) Filed: Nov. 14, 2016

(65) Prior Publication Data

US 2018/0135362 A1 May 17, 2018

(51) Int. Cl.

| | |
|---|---|
| ***E21B 19/08*** | (2006.01) |
| ***E21B 19/06*** | (2006.01) |
| ***E21B 21/08*** | (2006.01) |
| ***E21B 33/06*** | (2006.01) |
| ***E21B 33/08*** | (2006.01) |
| *E21B 4/02* | (2006.01) |

(52) U.S. Cl.

CPC ..... *E21B 19/06* (2013.01); *E21B 19/08* (2013.01); *E21B 21/08* (2013.01); *E21B 33/06* (2013.01); *E21B 33/085* (2013.01); *E21B 4/02* (2013.01)

(58) Field of Classification Search

CPC ..... E21B 21/02; E21B 21/08; E21B 21/10; E21B 21/106; E21B 19/06; E21B 19/07; E21B 19/16

See application file for complete search history.

(56) References Cited

U.S. PATENT DOCUMENTS 5,388,651 A * 2/1995 Berry ..... E21B 19/16 175/113
5,447,200 A 9/1995 Dedora et al.
(Continued)

FOREIGN PATENT DOCUMENTS

AT 475776 T 8/2010
AT 493562 T 1/2011
(Continued)

OTHER PUBLICATIONS

Schlumberger Oilfield Glossary slide accessed Sep. 2018 https://www.glossary.oilfield.slb.com/en/Terms/s/slide.aspx (Year: 2018).*
(Continued)

*Primary Examiner* — Brad Harcourt
*Assistant Examiner* — David Carroll
(74) *Attorney, Agent, or Firm* — MH2 Technology Law Group LLP

(57) ABSTRACT

A connector tool is used to direct fluids from a lifting assembly into a bore of a downhole tubular. The connector tool includes a body having an upper end and a lower end. The upper end is configured to be coupled to the lifting assembly, and the lower end is configured to be coupled to the downhole tubular. A telescopic engagement assembly is coupled to the body and configured to selectively extend and retract a seal assembly disposed at a distal end of the connector tool with a proximal end of the downhole tubular. A pump is coupled to the lifting assembly such that rotational movement from a component of the lifting assembly directs fluid to extend and retract the telescopic engagement assembly.

23 Claims, 16 Drawing Sheets

FIG. 4

(56) References Cited

U.S. PATENT DOCUMENTS

| | | | | |
|---|---|---|---|---|
| 5,971,079 | A | 10/1999 | Mullins | |
| 6,173,777 | B1 | 1/2001 | Mullins | |
| 6,390,190 | B2 | 5/2002 | Mullins | |
| 6,415,862 | B1 | 7/2002 | Mullins | |
| 6,578,632 | B2 | 6/2003 | Mullins | |
| 6,604,578 | B2 | 8/2003 | Mullins | |
| 6,675,889 | B1 | 1/2004 | Mullins et al. | |
| 6,715,542 | B2 | 4/2004 | Mullins | |
| 6,722,425 | B2 | 4/2004 | Mullins | |
| 6,779,599 | B2 | 8/2004 | Mullins et al. | |
| 7,690,422 | B2 | 4/2010 | Swietlik et al. | |
| 8,002,028 | B2 | 8/2011 | Swietlik et al. | |
| 8,006,753 | B2 | 8/2011 | Swietlik et al. | |
| 8,047,278 | B2 | 11/2011 | Swietlik et al. | |
| 8,316,930 | B2 | 11/2012 | Clubb et al. | |
| 8,381,823 | B2 | 2/2013 | Swietlik et al. | |
| 2009/0200038 | A1 | 8/2009 | Swietlik et al. | |
| 2009/0205827 | A1* | 8/2009 | Swietlik | E21B 19/08 166/285 |
| 2009/0229837 | A1 | 9/2009 | Wiens et al. | |
| 2010/0032162 | A1 | 2/2010 | Olstad et al. | |
| 2015/0053424 | A1 | 2/2015 | Wiens et al. | |
| 2016/0319613 | A1* | 11/2016 | Haughom | E21B 19/16 |

FOREIGN PATENT DOCUMENTS

| | | | |
|---|---|---|---|
| DK | 1795698 | T3 | 10/2010 |
| EP | 1131533 | A1 | 9/2001 |
| EP | 1700998 | A2 | 9/2006 |
| EP | 1700999 | A2 | 9/2006 |
| EP | 1703074 | A2 | 9/2006 |
| EP | 1795698 | A2 | 6/2007 |
| EP | 2105576 | A1 | 9/2009 |
| NO | 323539 | B1 | 6/2007 |
| NO | 326084 | B1 | 9/2008 |
| NO | 326469 | B1 | 12/2008 |
| NO | 326473 | B1 | 12/2008 |
| WO | 00/19060 | A1 | 4/2000 |

OTHER PUBLICATIONS

Schlumberger Oilfield Glossary mud motor accessed Sep. 2018 https://www.glossary.oilfield.slb.com/Terms/m/mud_motor.aspx (Year: 2018).*

Jin Ho Kim (Authorized Officer), International Search Report and Written Opinion dated Aug. 8, 2017, International Application No. PCT/US2016/067126, filed Dec. 16, 2016, pp. 1-17.

* cited by examiner

COMBINED CASING AND DRILL-PIPE FILL-UP, FLOW-BACK AND CIRCULATION TOOL

BACKGROUND

A circulation tool allows a driller to pump out of hole when tripping a drill pipe without the need to make-up a top drive to the drill pipe. A first type of circulation tool is a double-acting cylinder including a main body assembly with drill pipe connections on the top and bottom thereof. Inside the main body assembly, the first circulation tool includes a stinger shaft having an axial bore formed therethrough, a packer cup coupled to a lower end of the stinger shaft, and an internal valve assembly. A pneumatic accumulator is positioned on the outside of the main body assembly.

When the driller turns on a mud pump, mud flows through the first circulation tool. The mud causes the cylinder to extend and the valve to open. While the cylinder extends, air in the annulus of the cylinder is compressed. The valve remains open as the mud continues to flow. When the mud stops flowing, the valve closes, but the cylinder remains extended until the standpipe manifold is bled off to allow the mud on the top side of the tool to drain back into the pit at the surface. When the mud drains, the shaft retracts, due to the pneumatic pressure on the bottom side of the valve.

The operation of the first circulation tool may be dependent upon the operator setting up the first circulation tool with a specific pre-charge or pneumatic pressure on the underside of the tool. If the pressure is too high, the valve in the first circulation tool may not stay open under low-pressure mud flow. If the pressure is too low, the shaft may not retract.

As the first circulation tool relies upon the dynamic flow of mud to keep the valve open and the packer cup sealed, it is difficult to know the flow rate and pressure parameters that the driller must maintain to keep the first circulation tool positively engaged into the drill pipe. A combination of a pneumatic pressure that is too high and a flow rate that is too low may result in "pump out," causing a mud spill. In addition, the first circulation tool may have a length that requires the driller to run with longer bails to maintain a functional space between the elevator and the first circulation tool, which may require a change of the bails. This results in an increase in rig-up and rig-down time.

A second type of circulation tool may allow the driller to take flow-back when running in-hole. The second circulation tool is pneumatically driven to extend and retract using a control panel at the rig floor with an umbilical connecting the control panel to the second circulation tool. The control panel may provide air to extend and retract the second circulation tool. To extend the second circulation tool, the driller closes the inside blow-out preventer (IBOP), and air is pumped into the upper housing, causing the cylinder to extend and the valve to open. Once extended, the air supply is turned off, and the IBOP is opened, allowing flow-back from the drill pipe to the pit at the surface.

As the second circulation tool is extended, a port on the bottom side of the cylinder is vented to prevent any pressure build-up in the lower housing. Once the second circulation tool is extended and the valve is open, the second circulation tool stays engaged while flow-back pressures are low enough not to cause pump-out. If the driller runs in-hole too fast, however, the flow rate increases, and the pressure drop across the valve may cause the second circulation tool to pump out because there is no positive engagement when the second circulation tool is engaged and accepting flow-back.

As with the first circulation tool, the length of the second circulation tool may also require the change of bails.

In addition, the first and second circulation tools may both render the top drive pipe-handler redundant and/or inaccessible for make-up of the top drive to the drill pipe because the first and second circulation tools may be positioned below the saver sub. This may compromise and change the operation when the top drive needs to be screwed into the drill pipe.

SUMMARY

A connector tool for directing fluids from a lifting assembly into a bore of a downhole tubular is disclosed. The connector tool includes a body having an upper end and a lower end. The upper end is configured to be coupled to the lifting assembly, and the lower end is configured to be coupled to the downhole tubular. A telescopic shaft including a seal assembly is coupled to and/or positioned within the body and configured to selectively extend and retract the seal assembly disposed at a distal end of the connector tool with a proximal end of the downhole tubular. A pump is coupled to the lifting assembly and/or the body such that rotational movement from a component of the lifting assembly directs fluid to extend and retract the telescopic shaft including the seal assembly.

An assembly for moving a downhole tubular is also disclosed. The assembly includes a connector tool. The connector tool includes a body configured to be coupled to a lifting assembly. A telescopic shaft is positioned within the body, and the telescopic shaft is configured to extend and retract with respect to the body. A flow tube is positioned within the telescopic shaft, and the flow tube remains stationary with respect to the body when the telescopic shaft extends and retracts. An extension shaft is coupled to an end of the telescopic shaft. A guide nose is coupled to the extension shaft. A seal assembly is coupled to the extension shaft and configured to seal with an inner surface of the downhole tubular. A pump assembly is coupled to the connector tool or a rotating part of the lifting assembly. The pump assembly includes one or more hydraulic pumps, an internally-toothed ring gear to drive the one or more hydraulic pumps, and an anti-rotation device to hold the ring gear static relative to a part of the lifting assembly. The pump assembly is self-contained with no tie into a control from the lifting assembly, and hydraulic power in the pump assembly is generated by rotation of the lifting assembly.

A method for moving a downhole tubular in a wellbore is also disclosed. The method includes latching an elevator around the downhole tubular. A telescopic shaft of a connector tool is extended downward until a portion of the connector tool is engaged with an inner surface of the downhole tubular. An upper end of the connector tool is coupled to a lifting assembly. The lifting assembly moves the downhole tubular when the telescopic shaft is engaged with the inner surface of the downhole tubular. The telescopic shaft retracts upwards and until the portion (e.g., seal assembly) of the connector tool is removed from the downhole tubular after the downhole tubular has been moved. The elevator is unlatched from the downhole tubular.

The foregoing summary is intended merely to introduce a subset of the features more fully described of the following detailed description. Accordingly, this summary should not be considered limiting.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
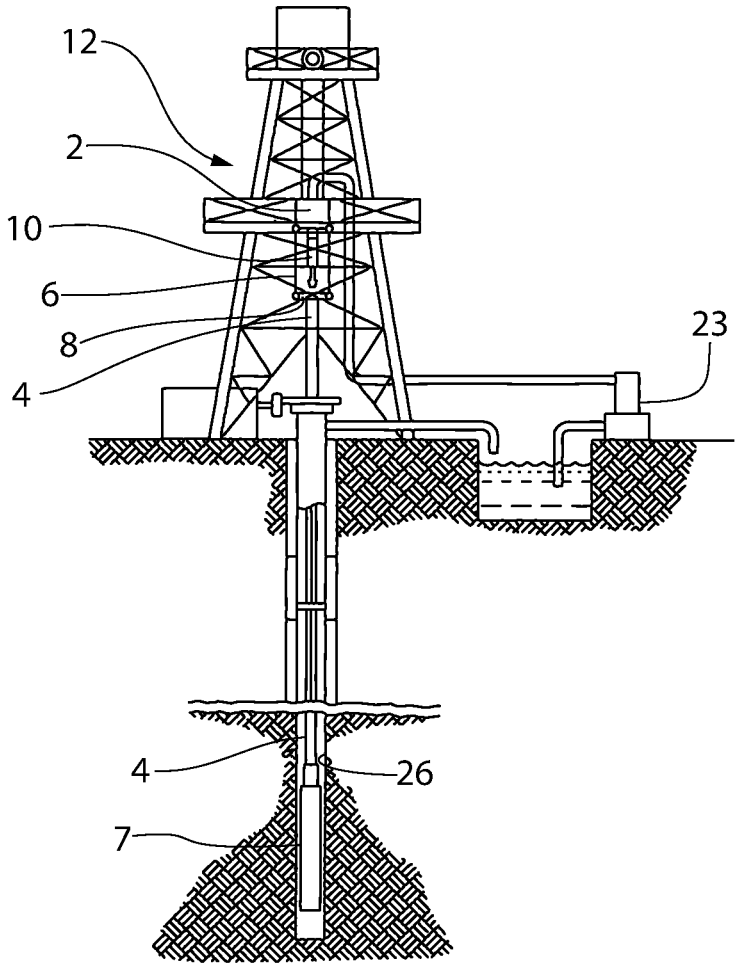
FIG. 1 illustrates a side view of a wellsite, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, reference numerals have been used throughout to designate identical elements, where convenient. In the following description, reference is made to the accompanying drawing that forms a part thereof, and in which is shown by way of illustration a specific exemplary embodiment in which the present teachings may be practiced. The following description is, therefore, merely exemplary.

Figure 2:
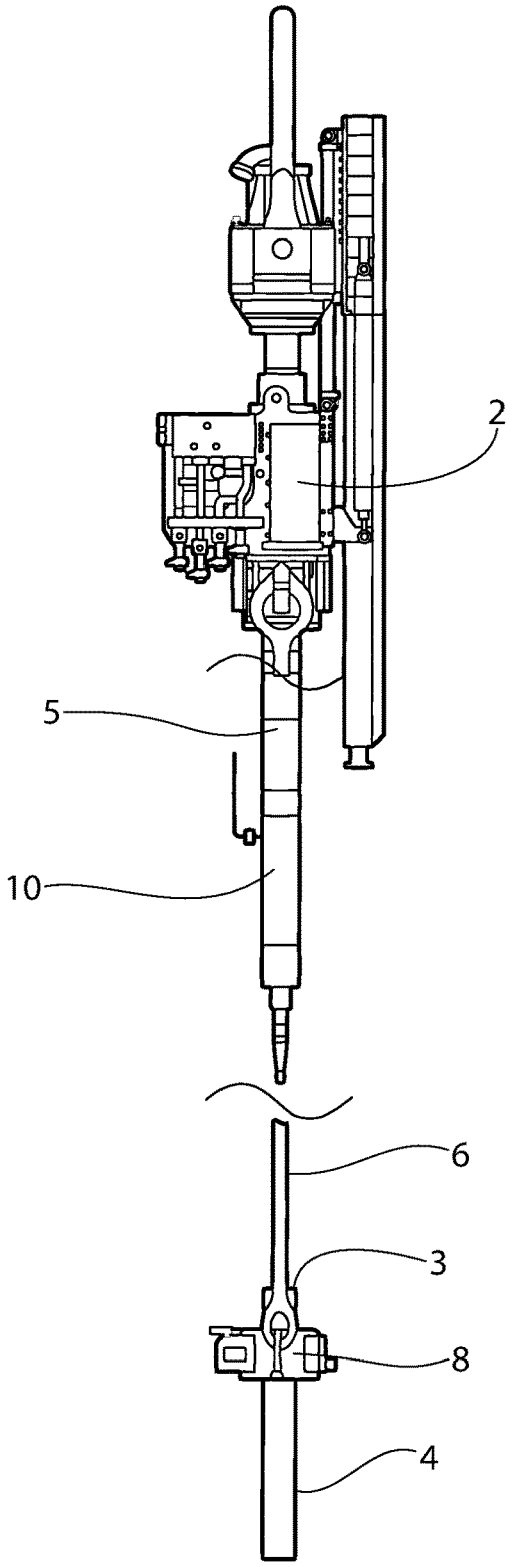
FIG. 2 illustrates side view of a connector tool coupled to and positioned between a top drive and a downhole tubular, according to an embodiment.

FIG. 1 illustrates a side view of a wellsite, and FIG. 2 illustrates side view of a portion of the wellsite showing a connector tool 10 coupled to and positioned between a top drive 2 and a plurality of downhole tubulars 4, according to an embodiment. At the wellsite, the top drive 2 is shown connected to a proximal end of a string of downhole tubulars 4. As shown, the top drive 2 may be capable of raising (i.e., "tripping out") and/or lowering (i.e., "tripping in") the downhole tubulars 4. A pair of lifting bails 6 may be connected between lifting ears of the top drive 2, and lifting ears of an elevator 8. When closed (as shown), the elevator 8 grips the downhole tubulars 4 to allow the string to be held static or lowered into or lifted out of a wellbore 26 (below).

The movement of the string of downhole tubulars 4 relative to the wellbore 26 may be restricted to the upward or downward movement of the top drive 2. While the top drive 2 supplies the upward force to lift the downhole tubulars 4, sufficient downward force is supplied by the accumulated weight of the entire free-hanging string of downhole tubulars 4, offset by the accumulated buoyancy forces of the downhole tubulars 4 in the fluids contained within the wellbore 26. Thus, as shown, the top drive 2, the lifting bails 6, and the elevator 8 are capable of lifting (and holding) the entire free weight of the string of downhole tubulars 4.

The downhole tubulars 4 may be or include drill pipes (i.e., a drill string 4), casing segments (i.e., a casing string 7), or any other length of generally tubular (or cylindrical) members to be suspended from a rig derrick 12. The uppermost section (i.e., the "top" joint) of the string of downhole tubulars 4 may include an open female-threaded "box" connection 3. In some applications, the uppermost box connection 3 is configured to engage a corresponding male-threaded ("pin") connector 5 at a distal end of the top drive 2 so that drilling-mud or any other fluid (e.g., cement, fracturing fluid, water, etc.) may be pumped (e.g., by a pump 23) through, or flowed back through, the top drive 2 to a bore of the downhole tubulars 4. As the downhole tubular 4 is lowered into a well, the uppermost section of downhole tubular 4 is disconnected from top drive 2 before a next joint of the string of downhole tubulars 4 may be threadably added.

The process by which threaded connections between the top drive 2 and the downhole tubular 4 are broken and/or made-up may be time consuming, especially in the context of lowering an entire string (i.e., several hundred joints) of downhole tubulars 4, segment-by-segment, to a location below the seabed in a drilling operation. The present disclosure therefore relates to alternative apparatuses and methods to establish the connection between the top drive 2 and the string of downhole tubulars 4 being held static, engaged, or withdrawn to and from the wellbore 26. Embodiments disclosed herein enable the fluid connection between the top drive 2 and the string of downhole tubulars 4 to be made using a connector tool 10 located between top drive 2 and the top joint of string of downhole tubulars 4. In at least one embodiment, the connector tool 10 may be hydraulic. Additional details about the connector tool 10 may be found in U.S. Pat. No. 8,006,753, which is incorporated by reference herein in its entirety to the extent that it is not inconsistent with the present disclosure.

However, it should be understood that while a top drive 2 is shown in conjunction with the connector tool 10, in certain embodiments, other types of "lifting assemblies" may be used with the connector tool 10 instead. For example, when running the downhole tubulars 4 on drilling rigs 12 not equipped with a top drive 2, the connector tool 10, the elevator 8, and the lifting bails 6 may be connected directly to a hook or other lifting mechanism to raise and/or lower the string of downhole tubulars 4 while hydraulically connected to a pressurized fluid source (e.g., a mud pump, a rotating swivel, an inside blowout preventer ("IBOP"), a TIW valve, an upper length of tubular, etc.). Further still, while some drilling rigs 12 may be equipped with a top drive 2, the lifting capacity of the lifting ears (or other components) of the top drive 2 may be insufficient to lift the entire length of string of downhole tubulars 4. In particular, for extremely long or heavy-walled tubulars 4, the hook and lifting block of the drilling rig 12 may offer significantly more lifting capacity than the top drive 2.

Therefore, throughout the present disclosure, where connections between the connector tool 10 and the top drive 2 are described, various alternative connections between the connector tool 10 and other, non-top-drive lifting (and fluid communication) components are contemplated as well. Similarly, throughout the present disclosure, where fluid connections between the connector tool 10 and the top drive 2 are described, various fluid and/or lifting arrangements are contemplated as well.

Figure 3:
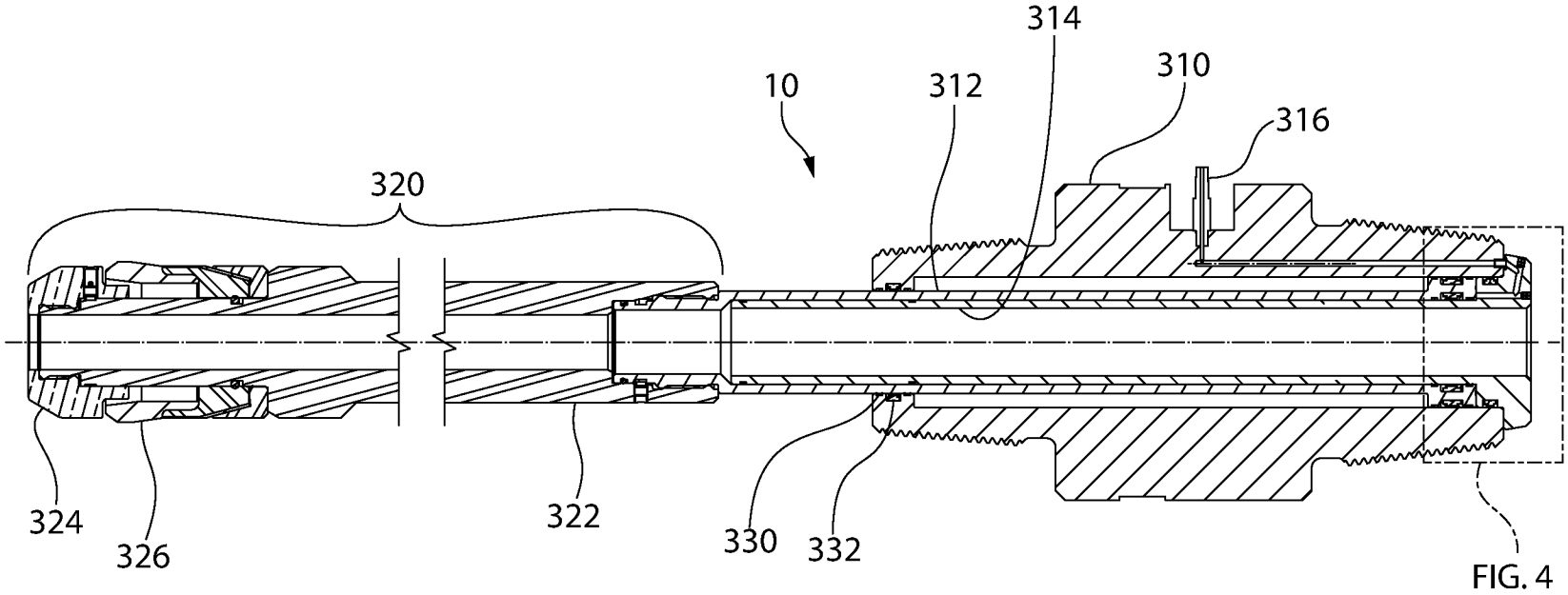
FIG. 3 illustrates a cross-sectional side view of the connector tool, according to an embodiment.
Figure 4:
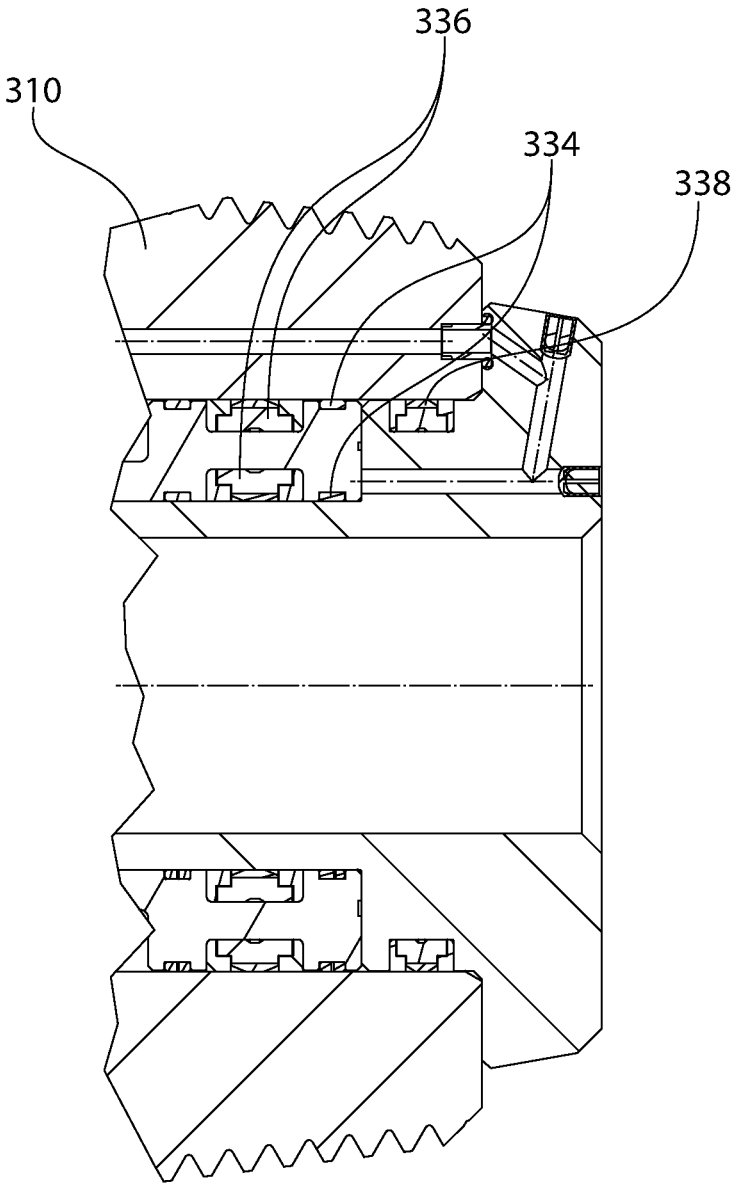
FIG. 4 illustrates an enlarged cross-sectional view of a portion of the connector tool shown in FIG. 3, according to an embodiment.

FIG. 3 illustrates a cross-sectional side view of the connector tool 10, and FIG. 4 illustrates an enlarged cross-sectional view of a portion of the connector tool 10, according to an embodiment. The connector tool 10 may include a main body 310 having a bore formed axially-therethrough. A telescopic shaft 312 may be positioned within the bore of the main body 310. The telescopic shaft 312 may be configured to extend and retract (e.g., telescope) with respect to the main body 310. A flow tube 314 may be positioned within the main body 310 and/or the telescopic shaft 312. The flow tube 314 may also have a bore formed axially-therethrough. The flow tube 314 may be stationary with respect to the main body 310. An extension shaft assembly (also referred to as a telescopic shaft including a seal assembly) 320 may be coupled to an end of the telescopic shaft 312. The extension shaft assembly 320 may include an extension shaft 322, a guide nose 324 coupled to the extension shaft 322, and a seal assembly (e.g., a cup seal) 326 coupled to the extension shaft 322. In another embodiment, the guide nose 324 and/or the seal assembly 326 may be coupled to the telescopic shaft 312, and the extension shaft 322 may be omitted. The main body 310 may include one or more hydraulic connections 316.

To assemble the connector tool 10, one or more seals 332 and one or more guide rings 330 may be positioned around and/or inside the main body 310. One or more seals 336 and one or more guide rings 334 may also be positioned around and/or inside the telescopic shaft 312. For example, one seal 336 and one guide ring 334 may be positioned in grooves on the exterior of the piston portion of the telescopic shaft 312 to seal between the outer diameter of the telescopic shaft 312 and the inner diameter of the main body 310. A second seal 336 and a second guide ring 334 may be positioned in grooves on the interior of the telescopic shaft 312 adjacent to the piston end of the telescopic shaft 312 to seal between the interior of the telescopic shaft 312 and the exterior of the flow tube 314. The telescopic shaft 312 may then be inserted at least partially into the main body 310. One or more seals 338 may be positioned around the flow tube 314. The flow tube 314 may then be inserted at least partially into the telescopic shaft 312, a few inches away from its home position. One or more seals (e.g., O-rings) may then be positioned around a sealing face of the flow tube 314, and the flow tube 314 may be moved into its home position. One or more fastening devices (e.g., cap screws) may then be used to couple the flow tube 314 to the main body 310. The extension shaft 322 may then be coupled to the telescopic shaft 312. The guide nose 324 and the seal assembly 326 may be coupled to the extension shaft 322. One or more hydraulic fittings may be coupled with the hydraulic connections 316.

The connector tool 10 may replace a saver sub. Conventional tools are located below a saver sub, which renders the pipe handler of the top drive 2 unusable for making/breaking connections. Replacing the saver sub with the connector tool 10 may allow the pipe handler to make/break connections.

Figure 5:
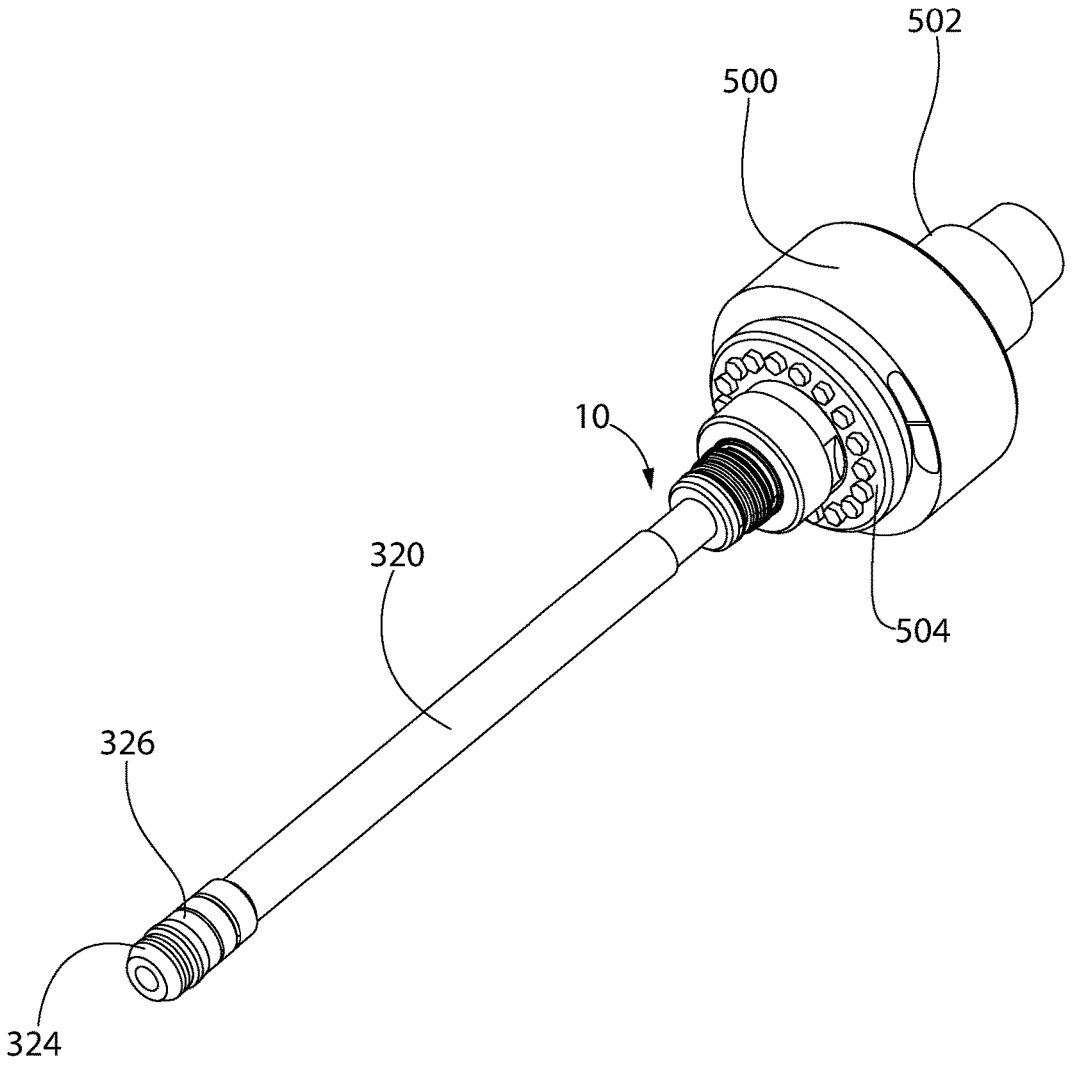
FIG. 5 illustrates a perspective view of a hydraulic pump assembly coupled to the connector tool and/or the IBOP, according to an embodiment.
Figure 6:
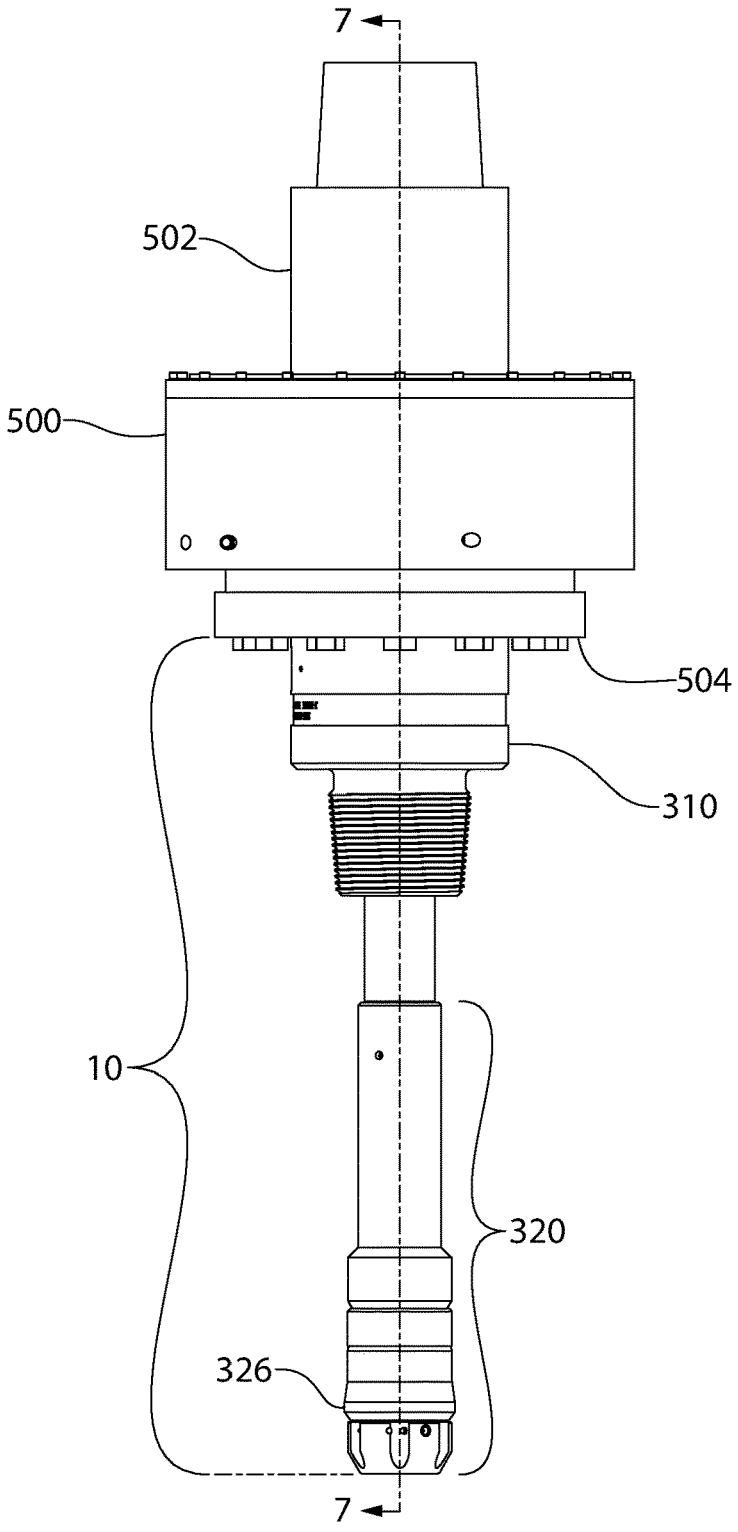
FIG. 6 illustrates a side view of the hydraulic pump assembly coupled to the connector tool and/or the IBOP, according to an embodiment.
Figure 7:
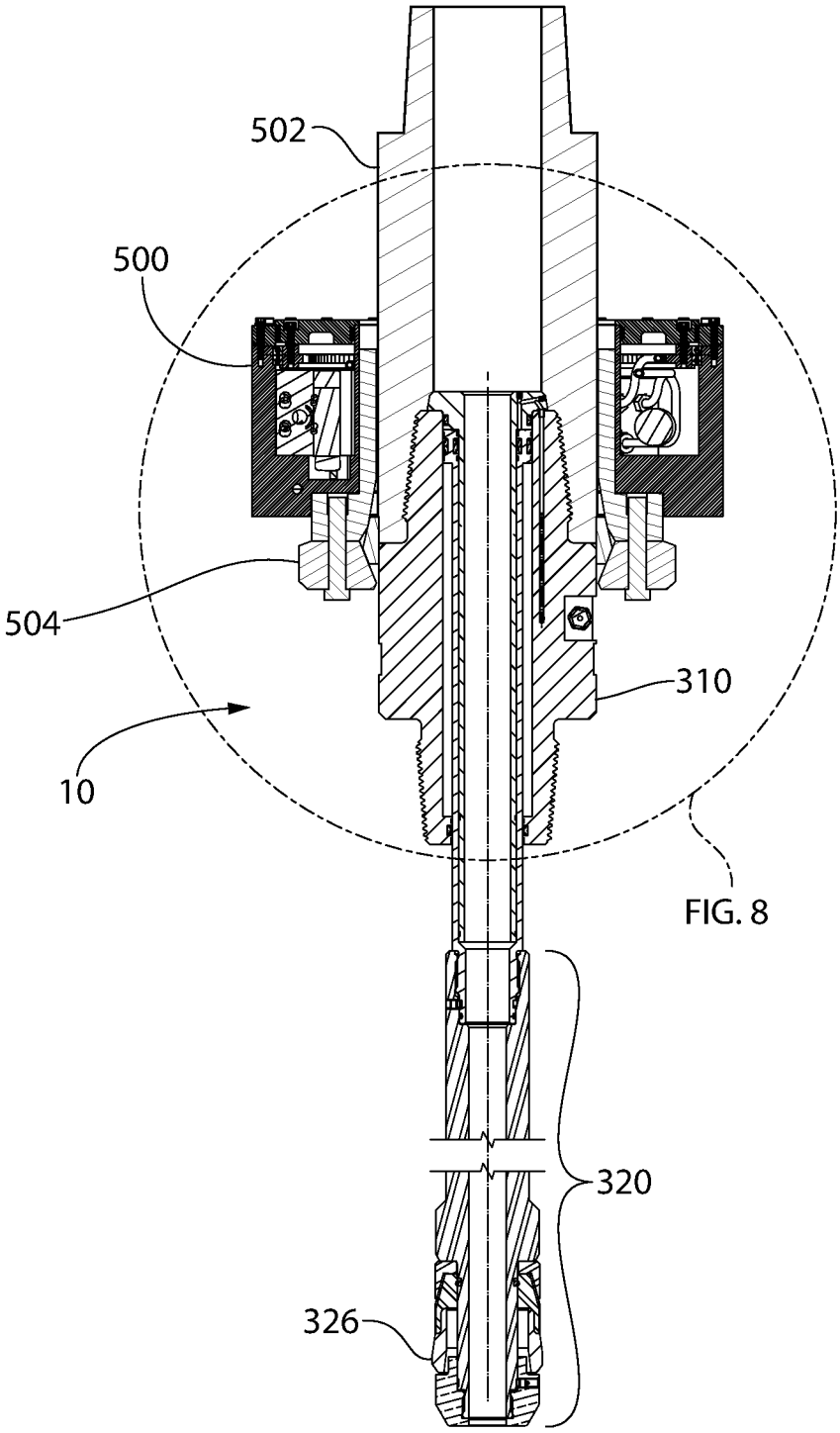
FIG. 7 illustrates a cross-sectional side view of the hydraulic pump assembly coupled to the connector tool and/or the IBOP, according to an embodiment.
Figure 8:
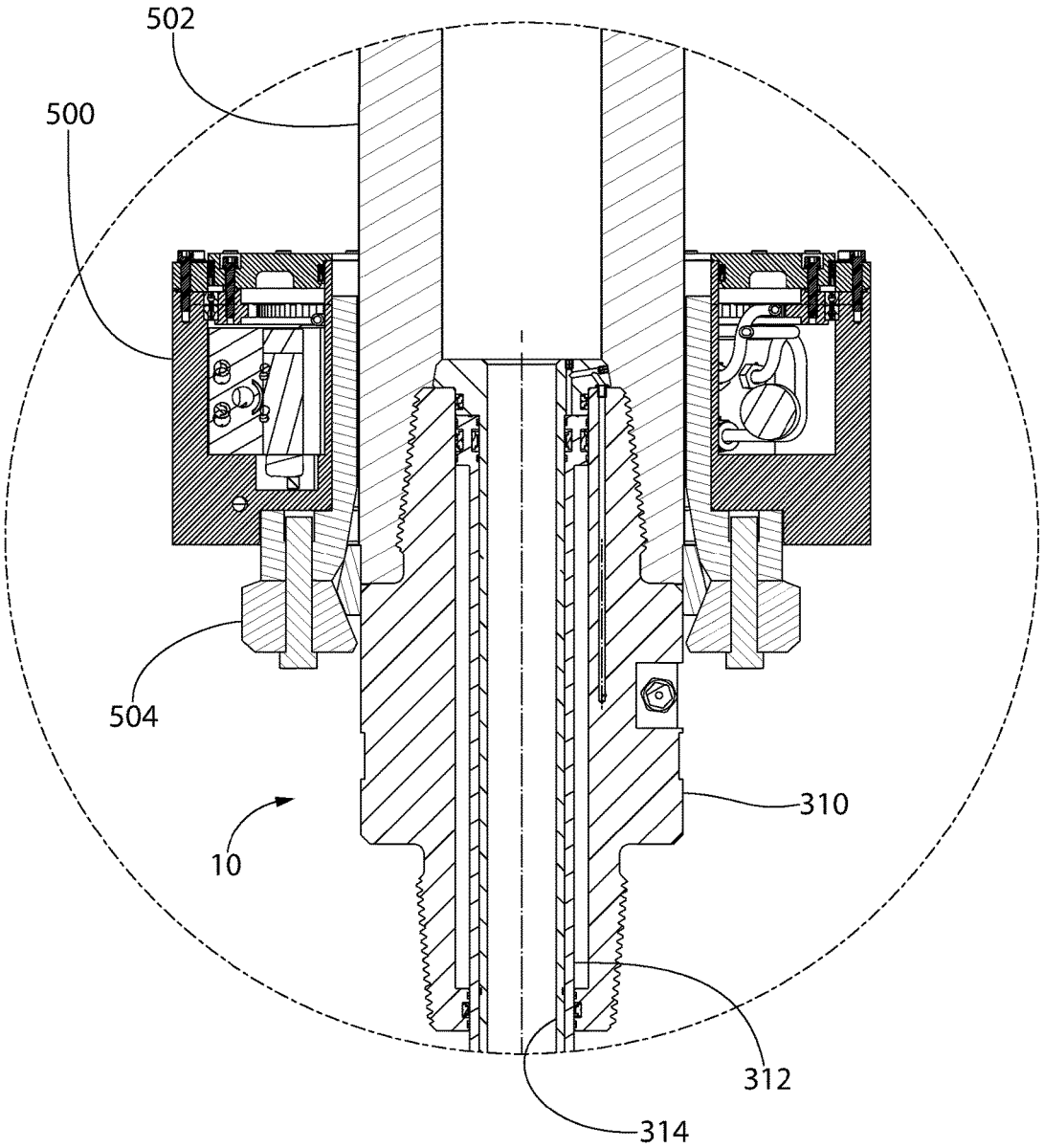
FIG. 8 illustrates an enlarged cross-sectional side view of a portion of the hydraulic pump assembly and the connector tool and/or the IBOP, according to an embodiment.

FIG. 5-7 illustrate a perspective view, a side view, and a cross-sectional side view of a hydraulic pump assembly 500 coupled to the connector tool 10 and IBOP valve 502, according to an embodiment. FIG. 8 illustrates an enlarged cross-sectional side view of a portion of the hydraulic pump assembly 500 and the connector tool 10 and IBOP valve 502, according to an embodiment. The IBOP valve 502 may be coupled to and/or positioned at least partially between the top drive 2 and the main body 310 of the connector tool 10. The connector tool 10 may include a pin-up connection to attach directly to the IBOP valve 502. In some embodiments, the IBOP valve 502 may include two or move valves (e.g., an upper and lower valve). In other embodiments, there may not be an IBOP valve directly above the connector tool 10 so the connector tool 10 may connect to another part of the top drive 2 in the same proximal position of where the IBOP valve is normally located.

The hydraulic pump assembly 500 may be clamped across the connection between the connector tool 10 and the IBOP valve 502 using, for example, a cross-coupling clamp 504 that prevents the hydraulic pump assembly 500 and the IBOP valve 502 from becoming rotationally disconnected in the event that the top drive 2 is turned in the counter-clockwise direction while breaking-out the drill pipe connection from the drill string. The hydraulic pump assembly 500 may be double acting, meaning that it may pump to extend the telescopic shaft 312 and pump to retract the telescopic shaft 312. The hydraulic pump assembly 500 may be self-contained and not tied into any control from the top drive 2. The hydraulic pump assembly 500, and the gear ratio between the ring gear and the gear on the pump shaft, may be sized so as to provide a flow rate that provides for a full extension of the telescopic shaft 312 in approximately 4-12 seconds.

The telescopic shaft 312 extends and retracts under low working pressures; however, the pressure within the connector tool 10 may become high in operation as a result of pump-out forces. The geometry (e.g., specifically the diameters) of each part define the area differential between the "pump-out" area (e.g., the OD of the seal assembly 326 minus the ID of the bore) and the "extend" area (e.g., the ID of the main body 310 minus the OD of the flow tube 314). For example, if the extend area is half of the pump-out area, the hydraulic pressure of the oil in the extend port may be twice that of the downhole circulating pressure. The ratio may be almost 3:1 for the largest cup size. As a result, the hydraulic oil pressure may rise to about 15,000 PSI when the rig is circulating at 5000 PSI. The connector tool 10 is rated for 15,000 PSI kick pressures, so the geometry of the parts has been designed to limit the hydraulic oil pressure to 15,000 PSI. This allows the bore of the main body 310 to be minimized, which may help maintain high strength in the pin-end connections.

Figure 9A:
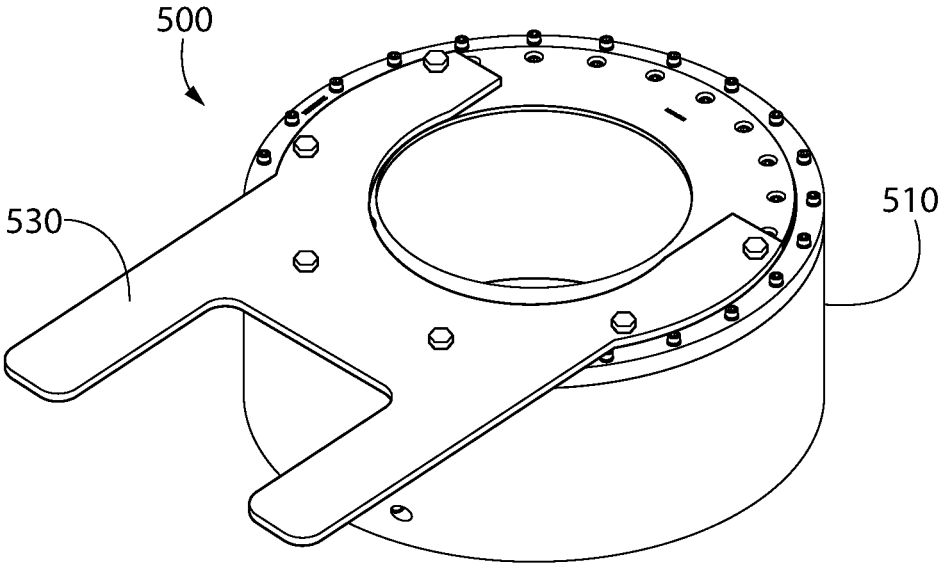
FIG. 9A illustrates a perspective view of the hydraulic pump assembly with an anti-rotation device coupled thereto, according to an embodiment.
Figure 9B:
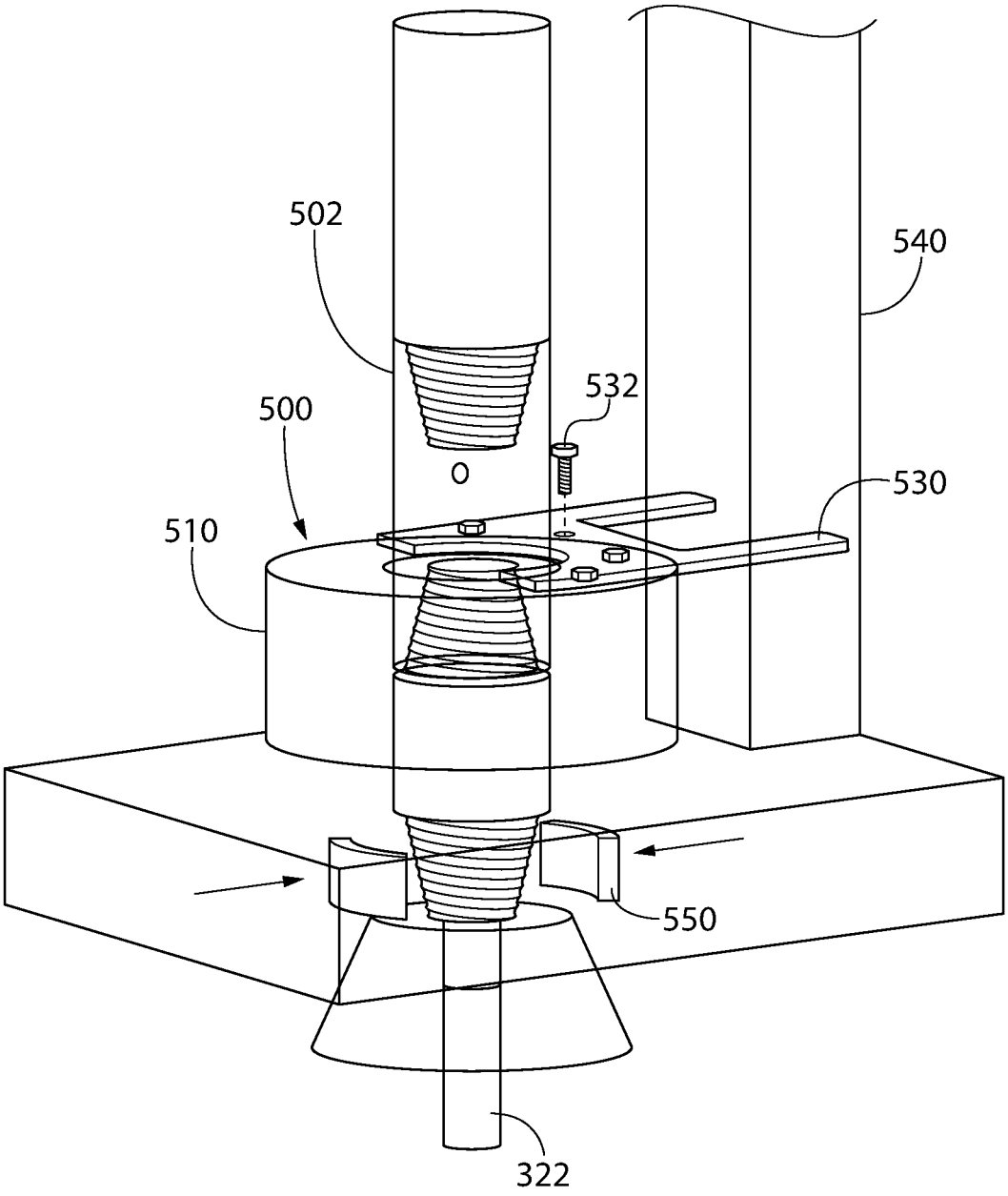
FIG. 9B illustrates a transparent perspective view of the anti-rotation device coupled to and positioned between the hydraulic pump assembly and a static portion of the lifting assembly (e.g., a torque tube), according to an embodiment.

FIG. 9A illustrates a perspective view of the hydraulic pump assembly 500 with an anti-rotation device 530 coupled thereto, according to an embodiment. FIG. 9B illustrates a transparent perspective view of the anti-rotation device 530 coupled to and positioned between the hydraulic pump assembly 500 and a static portion of the top drive 2 (e.g., a torque tube 540). The anti-rotation device 530 may be coupled (e.g., bolted with one or more bolts 532) to the housing 510 of the hydraulic pump assembly 500 and be configured to index around the torque tube 540. The anti-rotation device 530 may have a quick-release mechanism on the housing side so that it may clip on and off to allow it to be removed when not needed. Although not shown, in another embodiment, the anti-rotation device 530 may include a band or chain coupled to two or more points on the top of the bonnet (i.e., the stationary top part of the housing 510) that loops around the back of the torque tube 540 or around another rotationally-static portion of the top drive 2. A pipe handler grip jaw 550 may be positioned below the housing 510 and in its normal position where it may grip the top connection of the drill string.

Figure 10:
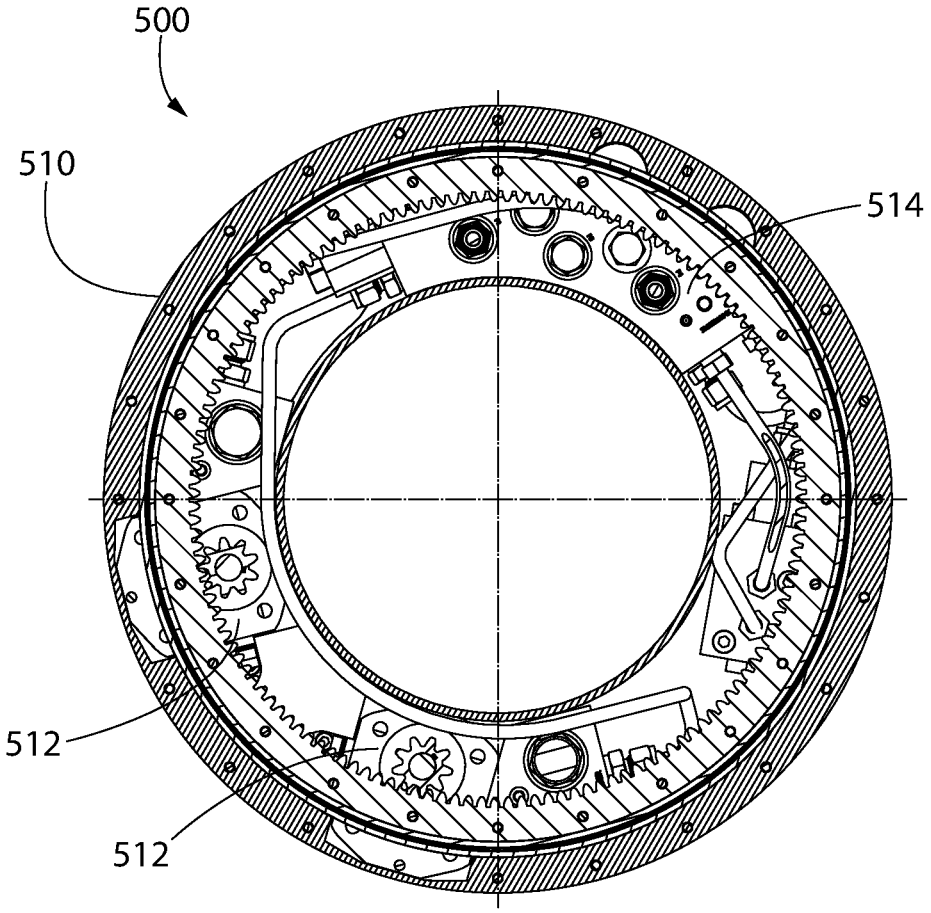
FIG. 10 illustrates a cross-sectional, top view of the hydraulic pump assembly, according to an embodiment.
Figure 11:
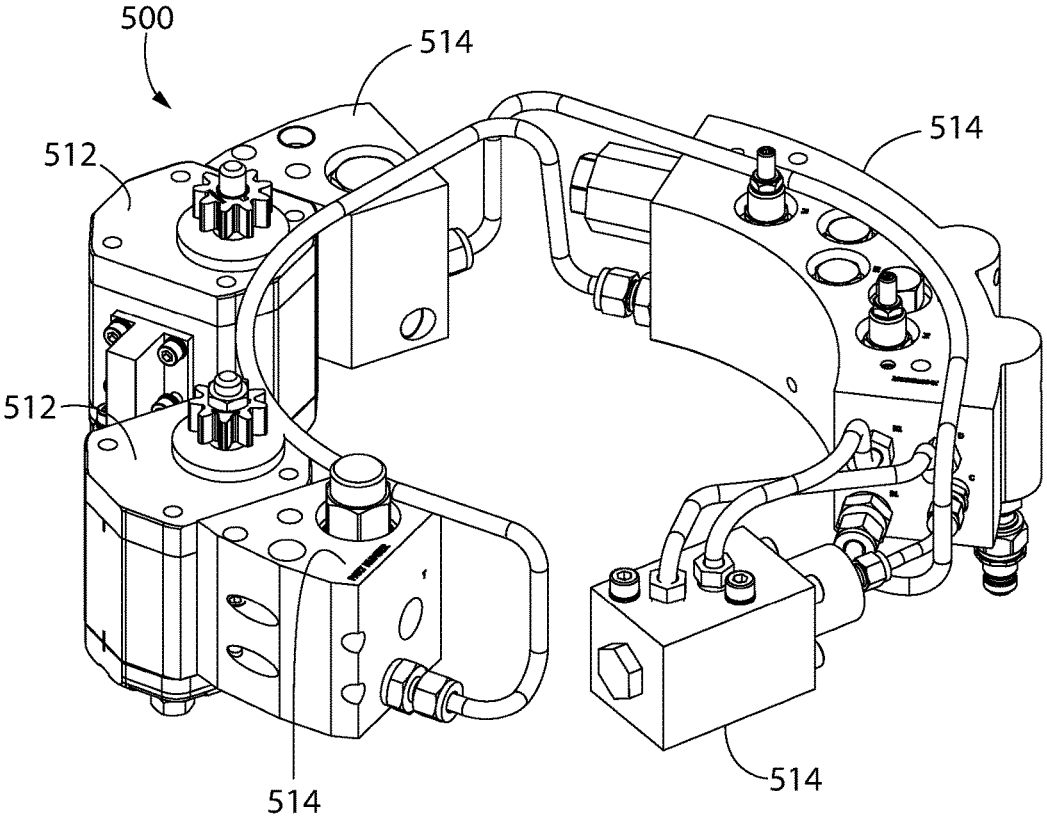
FIG. 11 illustrates a perspective view of the hydraulic pump assembly hydraulic components with the housing and the ring gear omitted, according to an embodiment.

FIG. 10 illustrates a cross-sectional view of the hydraulic pump assembly 500, according to an embodiment. FIG. 11 illustrates a perspective view of the hydraulic pump assembly 500 with a housing 510 and ring gear omitted, according to an embodiment. The hydraulic pump assembly 500 may include the housing 510, one or more hydraulic pumps (two are shown: 512), and one or more control valves 514. The housing 510 may have an inner diameter that is marginally larger than an outer diameter of the main body 310 of the connector tool 10 and the IBOP valve 502. The control valves 514 may have different functions, as described in more detail below.

Figure 12:
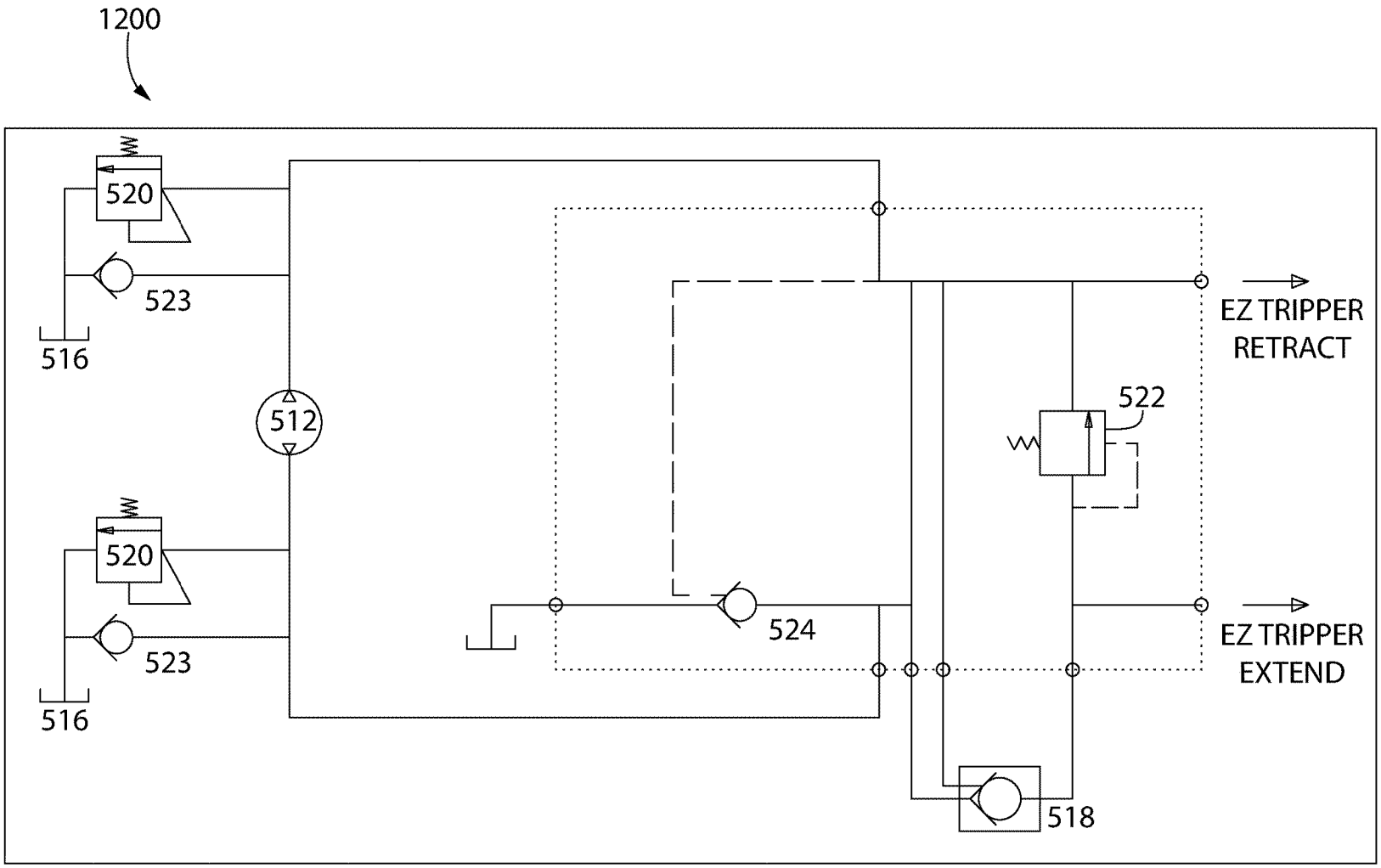
FIG. 12 illustrates a schematic view of a hydraulic circuit for the hydraulic pump assembly, according to an embodiment.

FIG. 12 illustrates a schematic view of a hydraulic circuit 1200 for the hydraulic pump assembly 500 with a single hydraulic pump 512, according to an embodiment. The hydraulic pump assembly 500 may be self-contained with no tie into any control from the top drive 2. More particularly, there is no tie back to a power unit on the rig floor or a rig hydraulic power supply. The hydraulic pump assembly 500 may include the pumps 512. The hydraulic pump assembly 500 may also include one or more header tanks (two are shown: 516) having a working fluid (e.g., oil) disposed therein. One or more of the pumps 512 may be at least partially submerged in the header tanks 516 to improve heat dissipation from the pumps 512 to the oil and, in turn, to the housing 510.

The control valves 514 from FIG. 11 are more specifically labelled as 518, 520, and 522 in FIG. 12 to identify their different functions. For example, the control valve 518 may be a check valve that may be used to seal the fluid volume inside the connector tool 10 once the telescopic shaft 312 has extended so that the telescopic shaft 312 cannot be pumped-out for the drill pipe connection. The control valve 518 may be rated at, for example, 15,000 PSI. The control valves 520 may be relief valves that may be used for the extend-and-retract functions. More particularly, the control valves 520 may be used to prevent over-pressure and pump damage while the telescopic shaft 312 reaches full stroke. One or more control valves 523 may be or include check valves that allow the pump 512 to draw fluid from the tank 516 during the extend and retract cycles of the telescopic shaft 312. Another control valve 524 may be a check valve that allows fluid being expelled from the extend port of the connector tool 10 to return to the tank 516 at low pressure when the telescopic shaft 312 is being retracted. The control valve 522 may be a relief valve that may be used to limit the pressure-holding capability of the connector tool 10 when reacting to pump-out forces. This may allow the connector tool 10 to retract in the event of a kick exceeding about 5000 PSI. At this point, well control procedure is to make-up the connector tool 10 to the drill string. A ring gear may be used to drive the pumps 512. The ring gear may have internal teeth. The ring gear may rotate on a bearing surface. The anti-rotation device 530 may hold the ring gear stationary relative to the top drive 2.

During assembly, the upper end of the connector tool 10 may be coupled to the IBOP 502 (see FIG. 7). The connection between the connector tool 10 and the IBOP 502 may be torqued using the top drive 2 while the main body 310 is held stationary by the pipe handler jaws 550. The pipe handler of the top drive 2 may be moved out of the way to fit the tool joint lock 505. The hydraulic pump assembly 500 may be slid over the connector tool 10 and positioned such that the tool joint lock 505 is over the tool joint and with the hydraulic connection in close proximity with the connection on the connector tool 10.

The locking dies may be tightened to lock the tool joint lock 505 and maintain the hydraulic pump assembly 500 in situ during use. The hoses between the hydraulic pump assembly 500 and the connector tool 10 may be connected. The extension shaft 322 may be coupled to the telescopic shaft 312, and the nose guide 324 and the seal assembly 326 may be coupled to the extension shaft 322, as described above.

Figure 13:
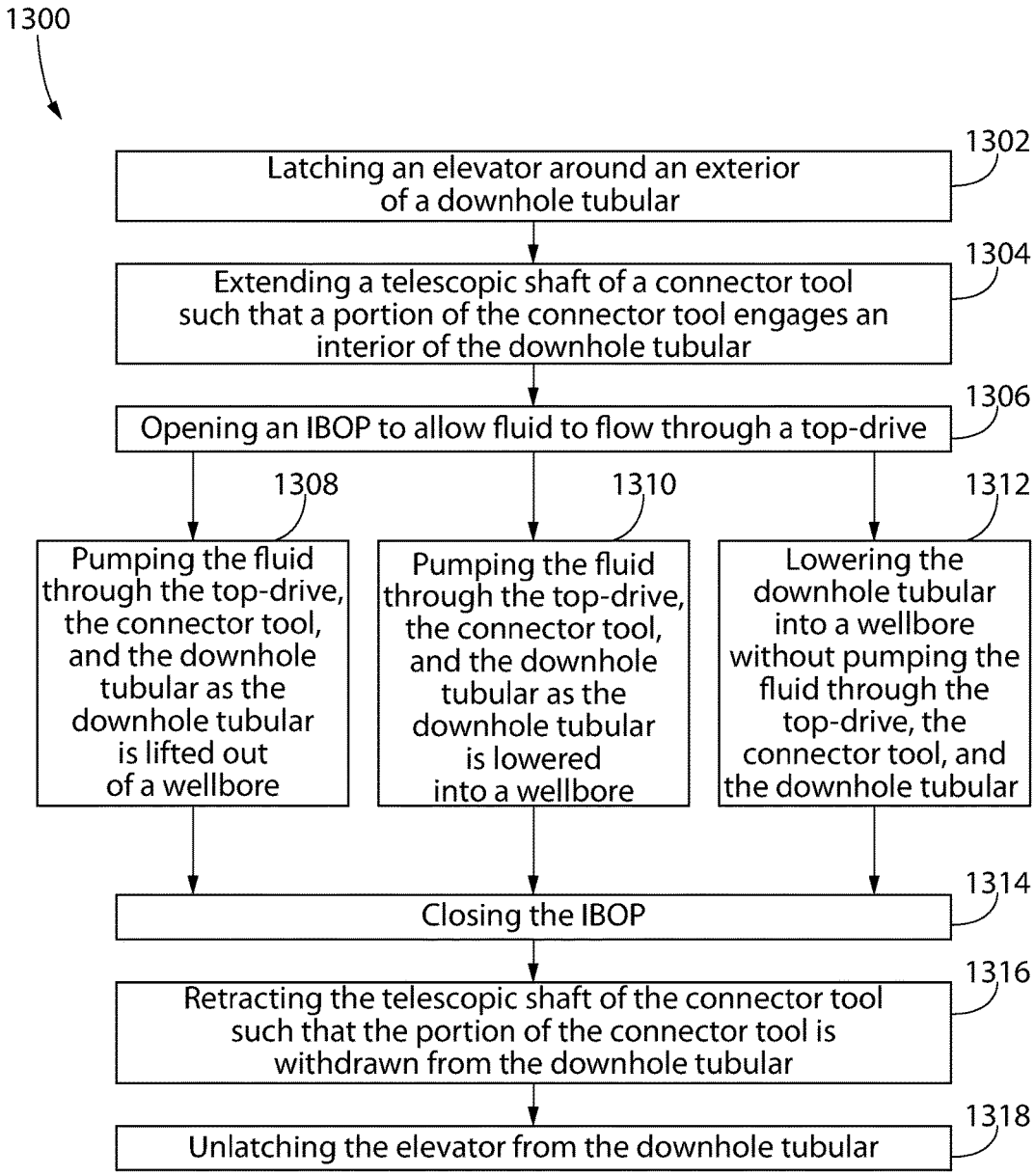
FIG. 13 illustrates a flowchart of a method for moving a downhole tubular in a wellbore, according to an embodiment.

FIG. 13 illustrates a flowchart of a method 1300 for moving a downhole tubular 4 in a wellbore 26, according to an embodiment. The method 1300 may include coupling (e.g., latching) the elevator 8 around an exterior of the downhole tubular 4, as at 1302. The downhole tubular 4 may be a segment of drill pipe, casing, etc. that is part of a string. Once coupled, the elevator 8 may support the weight of the downhole tubular 4 (e.g., the weight of the string). The method 1300 may also include extending the telescopic shaft 312 of the connector tool 10, as at 1304. The telescopic shaft 312 may be extended by rotating the top drive 2 in a first direction (e.g., clockwise) until the seal assembly of the connector tool 10 is engaged with an interior of the downhole tubular 4. Rotating the top drive 2 may generate the hydraulic flow and pressure in the housing 510 of the hydraulic pump assembly 500. The telescopic shaft 312 may be extended until the seal assembly 326 is engaged with the interior of the downhole tubular 4. This may take about 4 seconds, in which time the connector tool 10 may rotate about 1 to 2 full turns. There may be no hoses or umbilicals between the top drive 2 and the connector tool 10.

The method 1300 may also include opening an upper IBOP to allow fluid to flow through the top drive 2, as at 1306. The method 1300 may also include pumping fluid through the top drive, the connector tool 10, and the downhole tubular 4 as the downhole tubular 4 is lifted/raised out of the wellbore 26 (i.e., pumping out of hole), as at 1308. This may include actuating the rig's mud pumps to pump fluid and lift/raise the top drive 2. In another embodiment, instead of, or in addition to, pumping out of hole, the method 1300 may include pumping fluid through the top drive 2, the connector tool 10, and the downhole tubular 4 as the downhole tubular 4 is lowered into the wellbore 26 (i.e., filling on the run), as at 1310. In yet another embodiment, the method 1300 may include lowering the downhole tubular 4 into the wellbore 26 without pumping the fluid to take flow-back, as at 1312. In yet another embodiment, the method 1300 may include circulation while the downhole tubular 4 is held static in the wellbore, or the method 1300 may include circulation while drilling when using a mud motor and no string circulation is required. The mud motor may facilitate drilling.

The method 1300 may also include closing the upper IBOP once the downhole tubular 4 is run in hole or pulled out of hole, as at 1314. The method 1300 may also include retracting the telescopic shaft 312 of the connector tool 10 such that the extension shaft assembly 320 is withdrawn from the downhole tubular 4, as at 1316. The telescopic shaft 312 may be retracted by rotating the top drive 2 in a second direction (e.g., counterclockwise). The telescopic shaft 312 may be retracted after the upper IBOP is closed. The method 1300 may also include decoupling (e.g., unlatching) the elevator 8 from the downhole tubular 4, as at 1318.

The method 1300 may be performed with no control umbilical. More particularly, some conventional tools include an umbilical and some can only operate when mud pumps are circulating fluid flow into the wellbore 26. In the present disclosure, there is no hose or umbilical between the static part of the top drive 2 or a control console on the rig floor and the connector tool 10 because of the positioning of the pump housing 510 on the rotating part of the top drive 2, as discussed above.

When the connector tool 10 is not in use for pumping, filling, or taking flow-back, the connector tool 10 may still be used as a saver sub. This may maintain space-out when running the connector tool 10 so the bails 6 (see FIGS. 1 and 2) do not need to be changed. To use the connector tool 10 as a saver sub, the shaft extension 322 may be removed, and the anti-rotation device 530 may be disconnected, though neither of these items may be removed. If this has been done, the housing 510 of the hydraulic pump assembly 500, including the ring gear, may turn with the top drive 2. As a result, the telescopic shaft 312 neither extends nor retracts. As such, no fluid (e.g., oil) flows, and there is no heat buildup.

When the anti-rotation device 530 is in place and the top drive 2 rotates, the connector tool 10 and the hydraulic pump assembly 500 may turn. The anti-rotation device 530 may hold the ring gear rotationally stationary with the top drive 2 and the pipe handler. As the housing 510 of the hydraulic pump assembly 500 rotates within the ring gear, the drive gears of the pumps 512 are turning, driven by relative rotational movement between the pump gears and the ring gear, thus generating fluid flow. Rotation in one direction (e.g., clockwise) may pump fluid from the header tank 516 to the extend port of the connector tool 10, causing the telescopic shaft 312 to extend. Rotation in the other direction (e.g., counterclockwise) may pump fluid to the retract port of the connector tool 10, causing the telescopic shaft 312 to retract.

Figure 14:
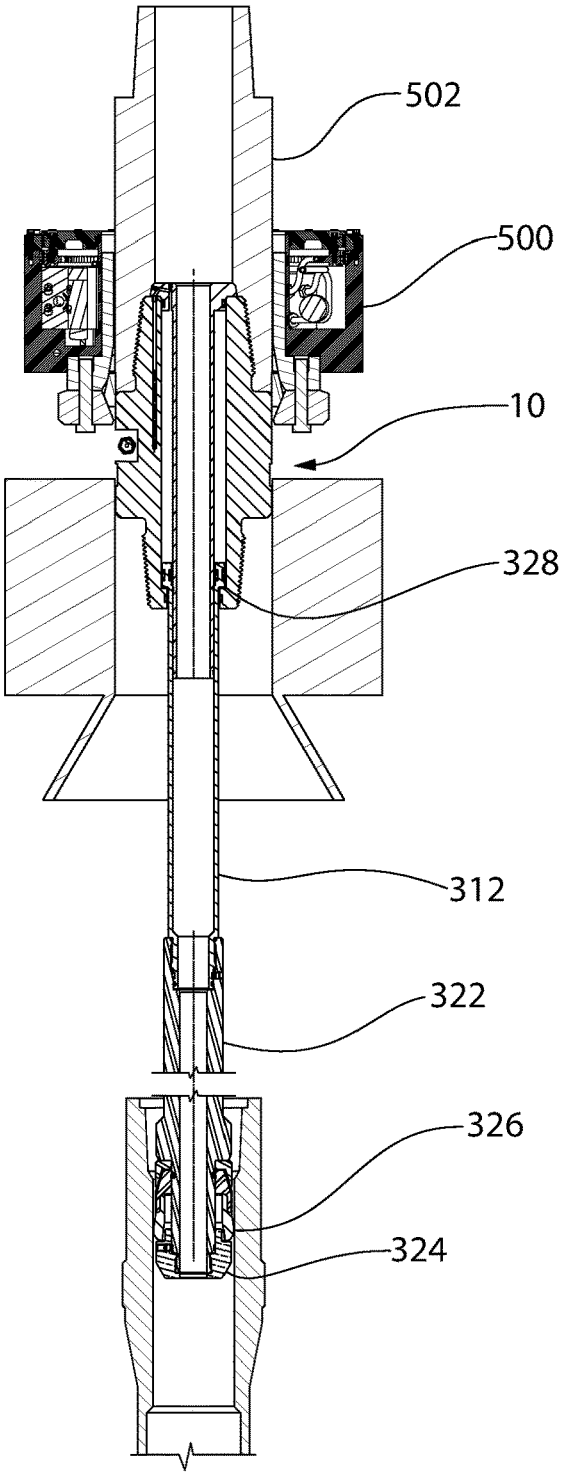
FIG. 14 illustrates a cross-sectional side view of the connector tool sealing inside a drill pipe, according to an embodiment.

FIG. 14 illustrates a cross-sectional side view of the connector tool 10 sealing inside a downhole tubular 4, according to an embodiment. To provide a seal with the downhole tubular 4, the seal assembly 326 may stop within the tool joint of the downhole tubular 4 where the diameter of the bore is known. The telescopic shaft 312 of the connector tool 10 may extend until a physical shoulder 328 is contacted within the connector tool 10 (i.e., the telescopic shaft 312 runs out of stroke). The seal assembly 326 may be coupled to the extension shaft 322.

Figure 15:
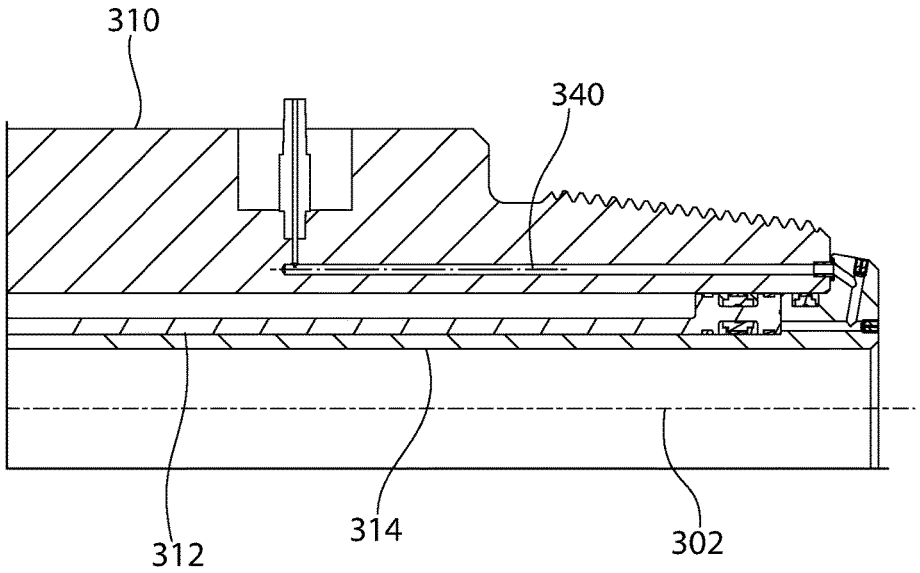
FIG. 15 illustrates a partial cross-sectional side view of a portion of the connector tool showing a port extending therethrough, according to an embodiment.

FIG. 15 illustrates a partial cross-sectional side view of a portion of the main body 310 of the connector tool 10, according to an embodiment. The main body 310 may have one or more ports (one is shown: 340) formed at least partially therethrough. The port 340 may be gun-drilled. The port 340 may be substantially parallel to a central longitudinal axis 302 through the main body 310. The oil may pass from the pump assembly 500, through the ports 340, and to an annulus of the connector tool 10 between the main body 310 on one side and the telescopic shaft 312 and/or the flow tube 314 on the other side.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A connector tool to direct fluids from a top drive into a bore of a downhole tubular, the connector tool comprising:

a body having an upper end and a lower end, wherein the upper end is configured to be coupled to the top drive, and wherein the lower end is configured to be coupled to the downhole tubular;

a telescopic engagement assembly positioned at least partially within the body and configured to selectively extend and retract a seal assembly disposed at a distal end of the connector tool into and out of the downhole tubular; and a pump coupled to the top drive, the body, or both, wherein rotation of the top drive in a first direction generates a pressure in the pump that causes the telescopic engagement assembly to extend the seal assembly into the downhole tubular, and wherein rotation of the top drive in a second direction generates a pressure in the pump that causes the telescopic engagement assembly to retract the seal assembly out of the downhole tubular.

2. The connector tool of claim 1, further comprising a flow tube positioned at least partially within the telescopic engagement assembly, wherein the flow tube remains stationary with respect to the body when the telescopic engagement assembly extends and retracts.

3. The connector tool of claim 1, wherein the pump is positioned at least partially around the body, an inside blowout preventer valve, or a connection between the body and the inside blowout preventer valve.

4. The connector tool of claim 3, wherein the body defines a port, and where a path of fluid communication is provided from the pump, through the port, and to an annulus between the body on one side and the telescopic engagement assembly on the other side.

5. The connector tool of claim 3, wherein the pump comprises:

one or more hydraulic pumps;

a ring gear to drive the one or more hydraulic pumps; and an anti-rotation device to hold the ring gear static relative to a pipe handler or the top drive.

6. The connector tool of claim 1, further comprising an extension shaft coupled to an end of the telescopic engagement assembly, wherein the seal assembly is coupled to the extension shaft.

7. The connector tool of claim 6, wherein the seal assembly is coupled to the extension shaft with no upset.

8. The connector tool of claim 1, wherein the seal assembly is coupled to the telescopic engagement assembly.

9. The connector tool of claim 1, wherein the connector tool comprises a pin-up connection that is configured to couple directly with an inside blowout preventer valve or with a portion of the top drive that is positioned above a saver sub.

10. An assembly for moving a downhole tubular, comprising:

a connector tool comprising:

a body configured to be coupled to a top drive;

a telescopic shaft positioned within the body, wherein the telescopic shaft is configured to extend and retract with respect to the body;

a flow tube positioned within the telescopic shaft, wherein the flow tube remains stationary with respect to the body when the telescopic shaft extends and retracts;

a guide nose coupled to the telescopic shaft; and a seal assembly coupled to the telescopic shaft and configured to seal with an inner surface of the downhole tubular; and a pump assembly coupled to the connector tool or a rotating part of the top drive, wherein the pump assembly comprises:

one or more hydraulic pumps;

a ring gear to drive the one or more hydraulic pumps; and an anti-rotation device to hold the ring gear static relative to a part of the top drive, wherein hydraulic power in the pump assembly is generated by rotation of the top drive.

11. The assembly of claim 10, further comprising an extension shaft coupled to the telescopic shaft, the guide nose, and the seal assembly, wherein the guide nose is coupled to the telescopic shaft via the extension shaft, and wherein the seal assembly is coupled to the telescopic shaft via the extension shaft.

12. A method for moving a downhole tubular in a wellbore, comprising:

removing a saver sub from a top drive;

installing a connector tool onto the top drive to replace the saver sub;

latching an elevator around the downhole tubular;

rotating a component of the top drive to direct fluid, thereby causing a telescopic shaft of the connector tool to extend downward until a portion of the connector tool is engaged with an inner surface of the downhole tubular, wherein an upper end of the connector tool is coupled to the top drive;

moving the top drive to move the downhole tubular when the telescopic shaft is engaged with the inner surface of the downhole tubular;

retracting the telescopic shaft upward and until the portion of the connector tool is removed from the downhole tubular after the downhole tubular has been moved; and unlatching the elevator from the downhole tubular.

13. The method of claim 12, wherein the connector tool comprises:

a body coupled to the top drive, wherein the telescopic shaft is positioned within the body;

a flow tube positioned within the telescopic shaft;

an extension shaft coupled to an end of the telescopic shaft;

a guide nose coupled to the extension shaft; and a seal assembly coupled to the extension shaft and configured to seal with the inner surface of the downhole tubular.

14. The method of claim 12, wherein the connector tool comprises:

a body coupled to the top drive, wherein the telescopic shaft is positioned within the body;

a flow tube positioned within the telescopic shaft;

a guide nose coupled to the telescopic shaft; and a seal assembly coupled to the telescopic shaft and configured to seal with the inner surface of the downhole tubular.

15. The method of claim 12, wherein moving the top drive to move the downhole tubular comprises lifting the top drive to lift the downhole tubular.

16. The method of claim 15, further comprising pumping fluid through the top drive, the connector tool, and the downhole tubular as the downhole tubular is lifted.

17. The method of claim 12, wherein moving the top drive to move the downhole tubular comprises lowering the top drive to lower the downhole tubular.

18. The method of claim 17, further comprising pumping fluid through the top drive, the connector tool, and the downhole tubular as the downhole tubular is lowered.

19. The method of claim 17, wherein the downhole tubular is lowered without pumping fluid through the top drive, the connector tool, and the downhole tubular.

20. The method of claim 12, further comprising:

ceasing movement of the top drive such that the downhole tubular is static; and pumping fluid through the top drive, the connector tool, and the downhole tubular as the downhole tubular is static.

21. The method of claim 12, further comprising pumping fluid through the top drive, the connector tool, and the downhole tubular to cause a mud motor to facilitate drilling when the downhole tubular is not rotating.

22. The method of claim 12, further comprising:

disconnecting an anti-rotation device from the connector tool; and rotating the top drive and a pump assembly that is coupled to the connector tool, thereby preventing the telescopic shaft from extending and retracting.

23. The method of claim 12, further comprising screwing the connector tool into the downhole tubular to establish fluid flow through the downhole tubular.

* * * * *